US009732532B1

(12) United States Patent
Yu

(10) Patent No.: US 9,732,532 B1
(45) Date of Patent: Aug. 15, 2017

(54) CONSTRUCTION METHOD FOR PROTECTING A SURFACE OF A STRUCTURE

(71) Applicant: Xiao-Hong Yu, Xiaogan (CN)

(72) Inventor: Xiao-Hong Yu, Xiaogan (CN)

( * ) Notice: Subject to any disclaimer, the term of this patent is extended or adjusted under 35 U.S.C. 154(b) by 0 days.

(21) Appl. No.: 15/393,753

(22) Filed: Dec. 29, 2016

(51) Int. Cl.

| | |
|---|---|
| ***E04B 1/00*** | (2006.01) |
| ***E04G 21/24*** | (2006.01) |
| ***E04F 15/12*** | (2006.01) |
| *E04G 21/20* | (2006.01) |

(52) U.S. Cl.
CPC ..... *E04G 21/24* (2013.01); *E04F 15/12* (2013.01); *E04G 21/20* (2013.01); *E04G 21/242* (2013.01)

(58) Field of Classification Search
CPC ..... E04G 21/20; E04G 21/24; E04G 21/242
USPC ..... 52/294, 295, 741.3, 741.1, 742.14
See application file for complete search history.

(56) References Cited

U.S. PATENT DOCUMENTS 1,508,233 A * 9/1924 Moody ..... E01B 9/18 238/371
5,517,790 A * 5/1996 Jennings ..... E04H 13/003 47/79
6,718,714 B1 * 4/2004 Montgomery, Sr. .. F24D 13/022 404/15
8,297,018 B2 * 10/2012 Peng ..... B28B 11/04 428/41.7
2003/0009964 A1 * 1/2003 Trarup ..... E02D 27/32 52/295
2011/0114819 A1 * 5/2011 Malushte ..... E04B 2/8647 249/190
2011/0239577 A1 * 10/2011 Hansen ..... E04G 23/0203 52/514
2015/0052842 A1 * 2/2015 Shaw ..... E04C 2/06 52/600
2015/0376859 A1 * 12/2015 Phuly ..... F03D 13/22 52/223.1
2016/0130798 A1 * 5/2016 Rahimzadeh ..... E04B 1/24 52/282.1

* cited by examiner

*Primary Examiner* — Chi Q Nguyen
(74) *Attorney, Agent, or Firm* — Rosenberg, Klein & Lee

(57) ABSTRACT

A construction method for protecting a surface of a structure is provided to protect interior and exterior surfaces of the structure before construction starts. The construction method is executed by laying a soft base material on the surfaces of the structure and covering the base material with a quick setting cement material to form a leveled cement plate with great wear resistance and pressure resistance whereby the surfaces are not damaged by any improper force derived from the construction. Thus, the construction efficiency is increased. The base material on which the quick setting cement material is laid can be easily removed from the surfaces of the structure without tools because the base material is not adhered to the surfaces. The base material can also be reused after being separated from the quick setting cement material to prevent the occurrence of environmental pollution and reduce the cost of construction.

6 Claims, 6 Drawing Sheets

CONSTRUCTION METHOD FOR PROTECTING A SURFACE OF A STRUCTURE

BACKGROUND OF THE INVENTION

1. Field of the Invention

This invention relates to a construction method and relates particularly to a construction method for protecting a surface of a structure.

2. Description of the Related Art

Generally, the decorator executes road construction or building decoration after attaching a plurality of plastic tiles on a surface of a construction zone of a structure. Therefore, the plastic tiles can prevent the surface of the structure from being worn and damaged during the road construction or the building decoration.

Here takes that the structure is a building as an example. Most of the floors in buildings are decorated with ceramic tiles, quartz tiles, or wooden planks. Generally, the surfaces of these materials cannot resist high friction and pressure caused by overburdened or heavy objects. However, many decoration devices will be applied during the decoration. What is worse, some of them may be heavy. When the decorator operates the decoration devices by pulling or pushing the decoration devices on the plastic tiles, the plastic tiles cannot withstand the high friction caused by the movement of the decoration devices effectively. Hence, the plastic tiles are torn and the floor which should be covered by the plastic tiles exposes to air without protection. In addition, the decoration devices will drag the plastic tiles along the floor after the plastic tiles break into fragments to therefore scar the floor. Furthermore, the floor may even be dented if it is furnished with the wood planks which has worse wear resistance than the ceramic tiles and the quartz tiles have. In other words, if the plastic tiles are broken, the surface of the floor covered by the plastic tiles cannot be well protected. Besides, the plastic tiles are provided without the buffer effect. If the decoration devices weight on the plastic tiles improperly, the plastic tiles cannot resist the high pressure caused by the decoration devices effectively to result in scratches in the floor or even break the floor. Thus, the protection effect of the plastic tiles is unsatisfied. Moreover, the damaged floor may require to be repaired to result in an additional repair cost. Thus, the aforementioned deficiencies should be improved.

SUMMARY OF THE INVENTION

The object of this invention is to provide a construction method for protecting a surface of a structure that provides the protection with the property of the wear resistance, pressure resistance, and buffering effect to prevent interior and exterior surfaces of the structure from being damaged by the improper force caused during the construction, thereby increasing the construction efficiency, avoiding the occurrence of the environmental pollution and reducing the cost of construction.

The construction method for protecting a surface of a structure of this invention comprises an initial setting step, a preparation step, a paving step, and an integration step in order. The preparation step is executed by preparing at least one soft base material and a quick setting cement material according to a beforehand measurement in the initial setting step. The measured surface of the structure is covered with the base material and the base material is further paved with the quick setting cement material in the paving step. Meanwhile, the quick setting cement material covered on the base material is leveled in the integration step in order to flat and solidify the quick setting cement material on the base material to form a complete cement plate. Therefore, the protection of the surface of the structure is finished and ready for proceeding with the construction. Because the surface of the structure is covered with the soft base material, the base material provides the surface of the structure with a primary protection to prevent the surface from contacting with the outside. Further, the quick setting cement material becomes the external layer to contact with the outside after being paved on the base material and turns into the cement plate which is opposite to the base material after being solidified. Therefore, the cement plate allows decoration devices to be transported thereon. Besides, the high friction caused by the movement of the decoration devices only applies to the cement plate without damaging the surface of the structure directly. Meanwhile, the high pressure caused when the decoration devices are used improperly can be taken by the soft base material. Because the base material is provided with resilience, the base material can resist the high pressure effectively to prevent the surface of the structure from being damaged when the cement plate transmits the high pressure toward the surface of the structure to prevent the surface of the structure from breaking into fragments. Therefore, the surface of the structure is protected from being damaged effectively during the construction and an additional repair cost of the surface of the structure is avoided after the construction is completed, thereby increasing the construction efficiency. In addition, because the base material is not fully bonded to the surface of the structure, the base material and the quick setting cement material can be removed without tools when the construction is finished. Furthermore, the base material can be reused after being separated from the quick setting cement material, thereby preventing the occurrence of environmental pollution and lowering the cost of construction.

Preferably, the bottom face of the base material is made of an anti-slip material capable of providing a non-slip effect.

Preferably, the bottom face of the base material is made of an adhesive material capable of providing a bonding effect.

DETAILED DESCRIPTION OF THE PREFERRED EMBODIMENTS

Figure 1:
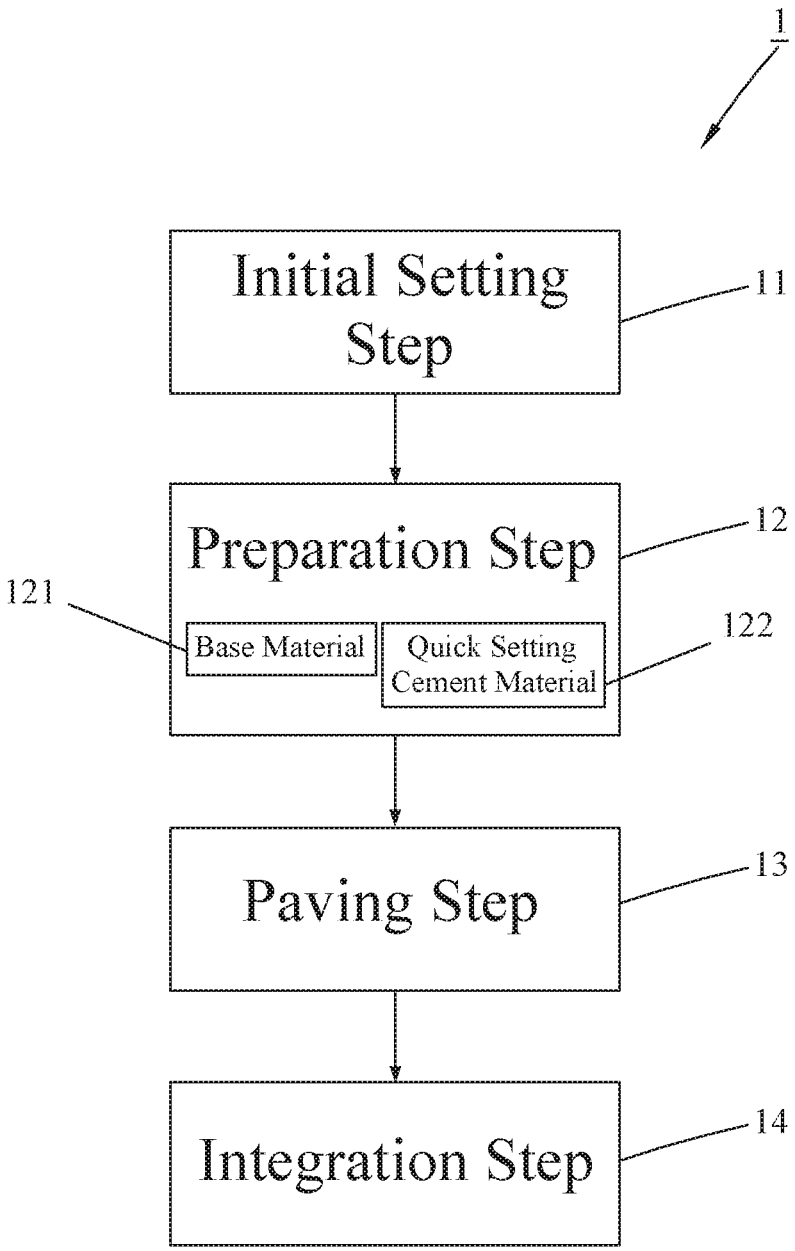
FIG. 1 is a schematic view showing steps of a first preferred embodiment of this invention.
Figure 2:
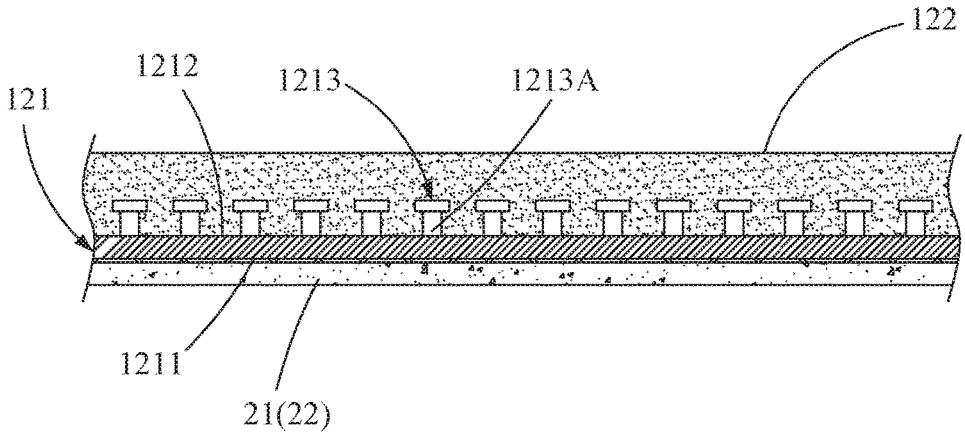
FIG. 2 is a cross-sectional view showing that the bottom face of the base material is made of an anti-slip material.
Figure 3:
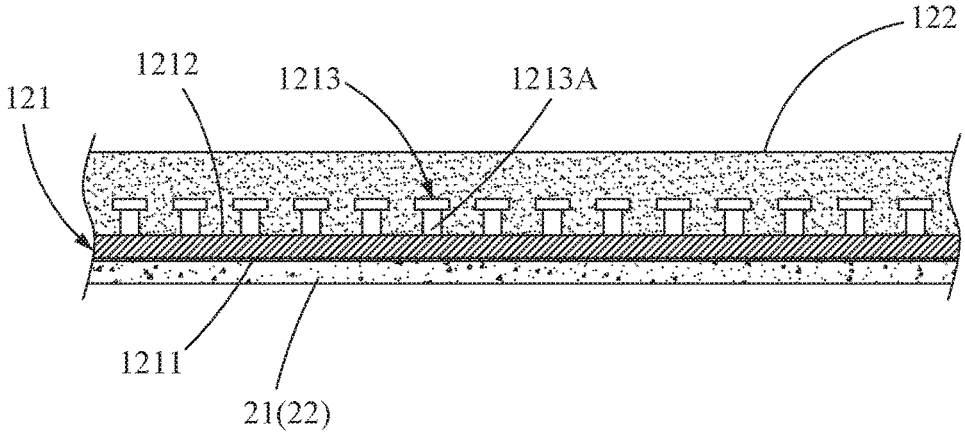
FIG. 3 is a cross-sectional view showing that the bottom face of the base material is made of an adhesive material.
Figure 4:
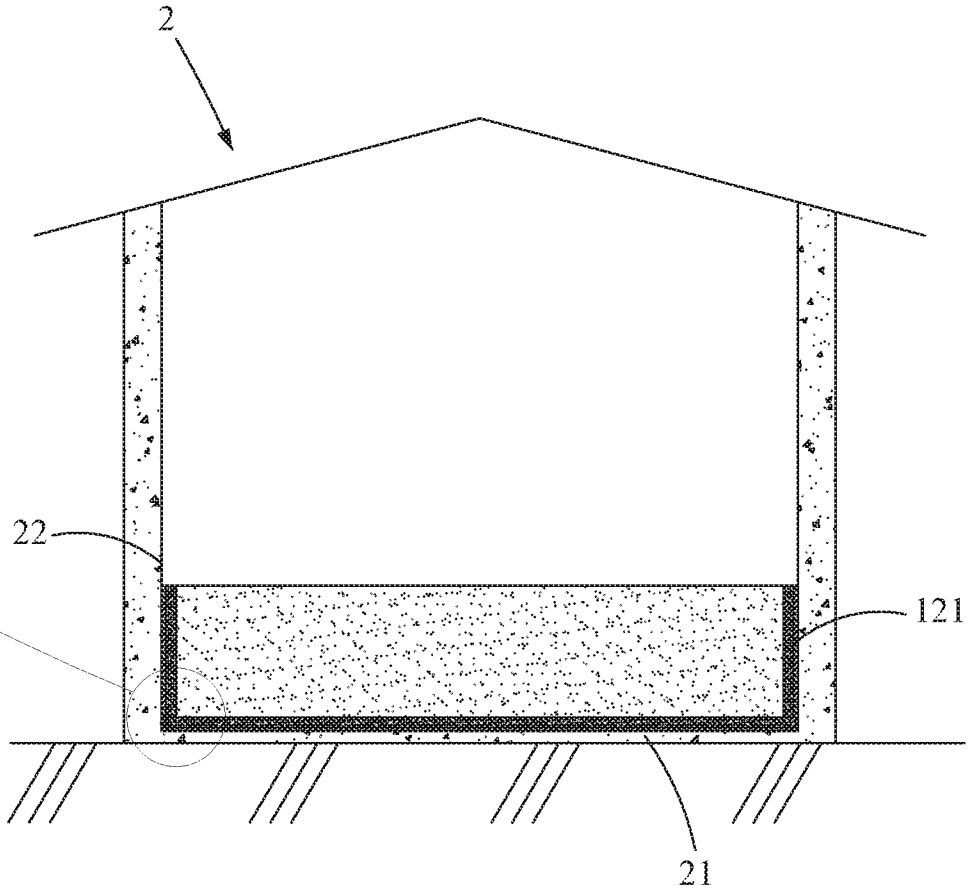
FIG. 4 is a cross-sectional view showing a simulation that the cement plate of the first preferred embodiment of this invention is arranged on the surface of the structure.
Figure 4A:
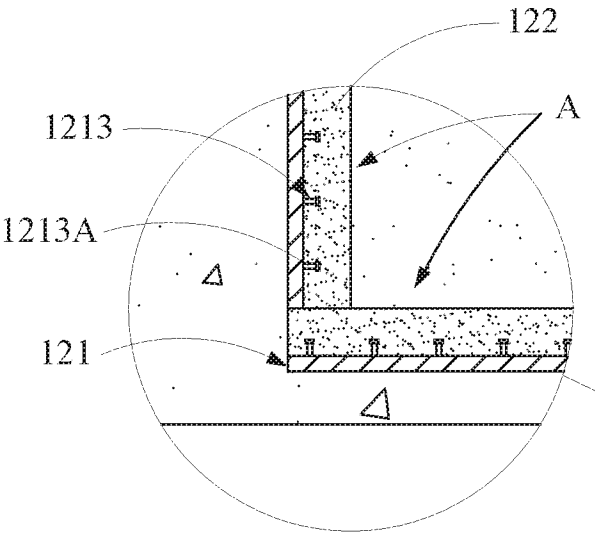
FIG. 4A is an enlarged view showing a partial element of FIG. 4.

Referring to FIGS. 1 and 4 show a first preferred embodiment of a construction method 1 for protecting a surface of a structure 2. Here takes that the structure 2 is a building as an example. The construction method 1 is applied to road construction or building decoration and aimed at protecting interior and exterior surfaces of the structure 2. Referring to FIG. 4, it is taken as an example that the interior and exterior surfaces of the structure 2 are the ground 21 and the wall 22 in this embodiment. The construction method 1 comprises an initial setting step 11, a preparation step 12, a paving step 13, and an integration step 14 in sequence. Referring to FIGS. 1, 4 and 4A, the initial setting step 11 is executed by measuring areas of the surfaces of the ground 21 and the wall 22 which is extended from the ground 21 of a construction zone (not shown) inside the structure 2. The preparation step 12 is aimed at preparing at least one soft base material 121 and a quick setting cement material 122 that are based on the measurement in the initial setting step 11. Referring to FIG. 2, the base material 121 has a bottom face 1211, a top face 1212 located at an opposite side to the bottom face 1211, and a plurality of connecting units 1213 formed on the top face 1212. Each connecting unit 1213 has a first portion 1213A connected with the top face 1212. Further, each first portion 1213A is provided with a reduced size. The base material 121 can be produced into one piece or several pieces which are convenient to be transported according to needs. In this embodiment, it is taken as an example that the base material 121 is formed in one piece as shown in FIG. 4. Meanwhile, the bottom face 1211 of the base material 121 can be provided with an anti-slip material capable of providing a non-slip effect as shown in FIG. 2 or an adhesive material capable of providing a bonding effect as shown in FIG. 3. Therefore, the bottom face 1211 takes advantages of different materials to fit different materials of the ground 21 and the wall 22. In other words, the bottom face 1211 can be provided with the anti-slip material or the adhesive material based on the materials of the ground 21 and the wall 22, thereby preventing the base material 121 from sliding. An amount of the quick setting cement material 122 is also prepared based on the measurement of the surfaces of the construction zone.

The paving step 13 is executed by locating the base material 121 on the measured surfaces of the construction zone of the structure 2. Therefore, the ground 21 of the structure 2 is covered with base material 121. The wall 22 extended from the ground 21 can also be covered with the base material 121 until the covering height meets the requirements of construction. The base material 121 is then paved with the quick setting cement material 122. In the integration step 14, the decorator levels the quick setting cement material 122 by a leveling tool (not shown) in order to make the quick setting cement material 122 smooth and well-mixed until the quick setting cement material 122 covers the base material 121 completely. Because the base material 121 is located between the ground 21 and the quick setting cement material 122 and between the wall 22 and the quick setting cement material 122, the quick setting cement material 122 will not contact with the ground 21 and the wall 22. Further, because the first portion 1213A of each connecting unit 1213 is produced with the reduced size, it enhances an engagement between the quick setting cement material 122 and the base material 121, thereby fixing the quick setting cement material 122 to the base material 121 tightly to further form a complete cement plate A.

Referring to FIGS. 1, 2, 4 and 4A, first of all, the construction method 1 begins with estimating and measuring the areas of the surfaces of the ground 21 and the wall 22 that require to be protected according to the construction zone of the structure 2. Second is to prepare the base material 121 and the quick setting cement material 122 based on the measurement of the ground 21 and the wall 22. The material of the bottom face 1211 of the base material 121 is selected according to the materials of the ground 21 and the wall 22 of the structure 2 to be the anti-slip or the adhesive materials as shown in FIG. 2 or FIG. 3 in order to preventing the base material 121 from slipping. Therefore, the initial setting step 11 and the preparation step 12 are completed to move on with the paving step 13. In the paving step 13, the base material 121 is situated on the ground 21 and the wall 22 extended from the ground 21 until the covering height of the base material 121 fits the requirements. The bottom face 1211 of the base material 121 locates at a place corresponding to the ground 21 and the wall 22. Meanwhile, the top face 1212 and the connecting units 1213 face the outside. After the base material 121 is finished laying, the quick setting cement material 122 is applied to the base material 121. When the quick setting cement material 122 is poured on the base material 121, the decorator can use the leveling tool to flat the quick setting cement material 122 and stop pouring the quick setting cement material 122 until the base material 121 is covered with the quick setting cement material 122 fully. Hence, the cement plate A is formed after the quick setting cement material 122 is dried. Meanwhile, during the solidifying process of the quick setting cement material 122, the quick setting cement material 122 can engage with the connecting units 1213. Because the first portion 1213A of each connecting unit 1213 is formed with the reduced size, the engagement between the quick setting cement material 122 and the base material 121 is increased. Hence, after the protection of the ground 21 and the wall 22 is completed, the decoration devices (not shown) can be applied. The cement plate A which is the combination of the quick setting cement material 122 and the base material 121 prevents the ground 21 and the wall 22 from being damaged effectively because it acts as an intermedium between the ground 21 and the decoration devices and between the wall 22 and the decoration devices. Therefore, the improper friction which is caused by the decoration devices to be applied on the surfaces of the ground 21 and the wall 22 can be avoided by the cement plate A whereby the ground 21 and the wall 22 are protected from being beyond repair. Moreover, because the base material 121 is designed to be soft, the high pressure which may break the ground 21 and the wall 22 can be absorbed by the base material 121, thereby preventing an additional repair cost of the ground 21 and the wall 22 after the construction is finished. Thus, the construction efficiency is increased. Furthermore, because the quick setting cement material 122 does not contact with the ground 21 and the wall 22, the decorator can remove the quick setting cement material 122 easily by pulling the base material 121 to therefore remove the cement plate A after the construction is completed. Besides, the cement plate A which is provided by the construction method 1 can be disposable. Alternatively, the base material 121 can be further kept for reuse after removing the quick setting cement material 122, thereby avoiding the occurrence of the environmental pollution and lowering the cost of construction.

Figure 5:
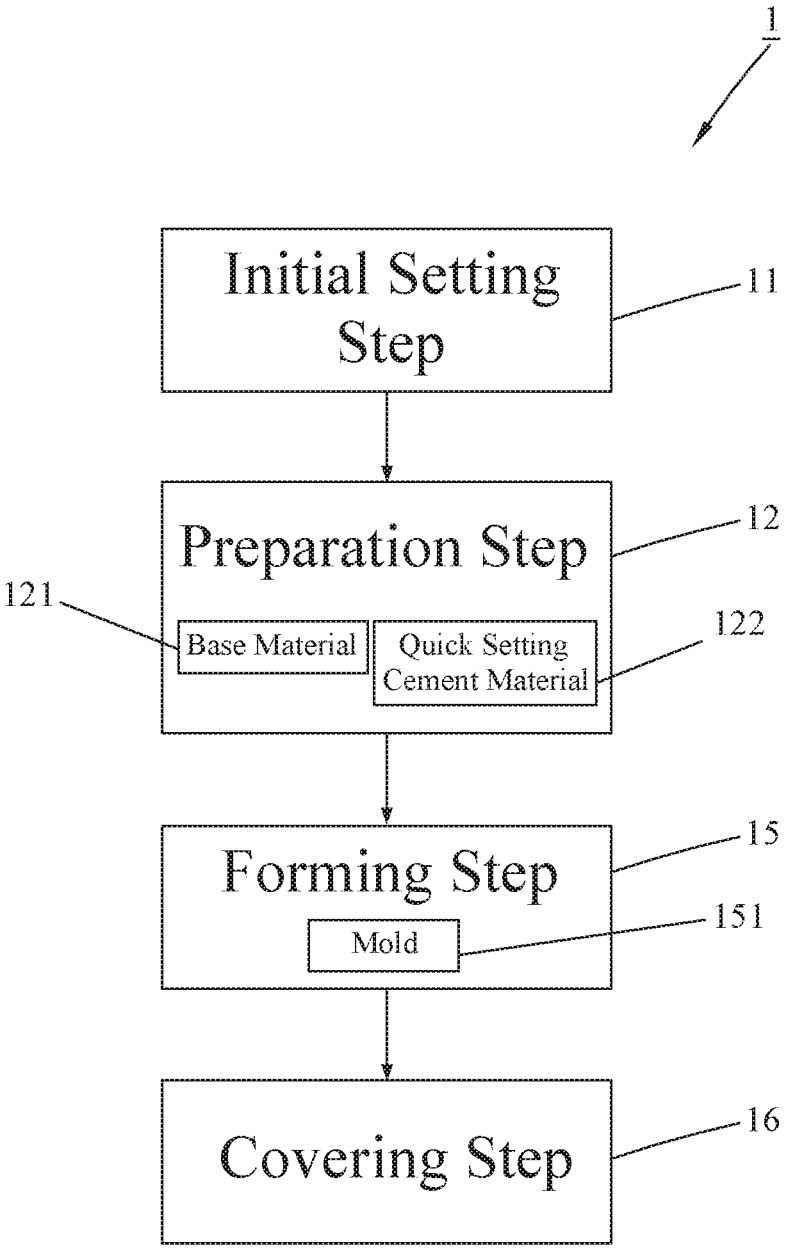
FIG. 5 is a schematic view showing steps of a second preferred embodiment of this invention.
Figure 6:
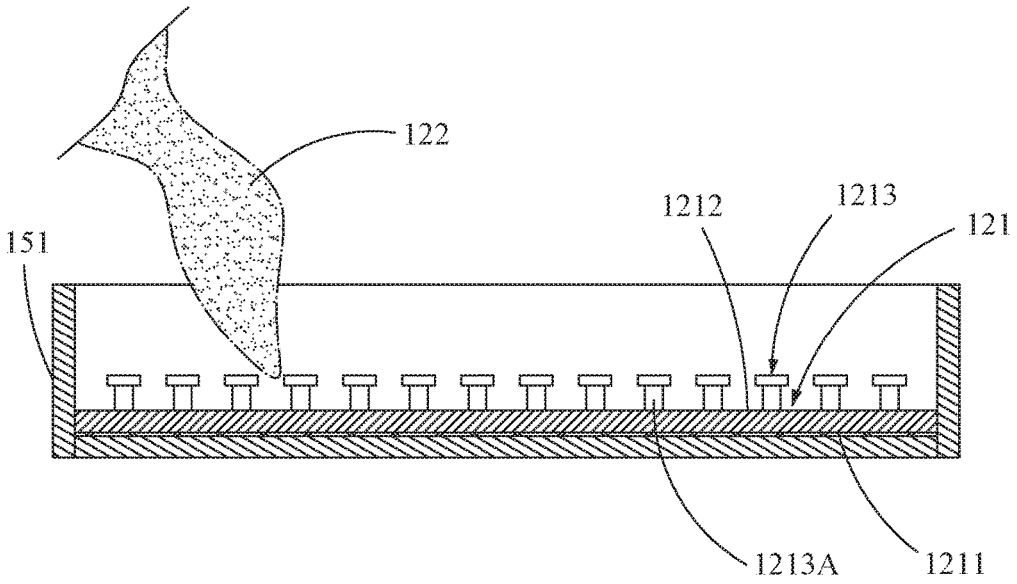
FIG. 6 is a cross-sectional view showing a simulation that the quick setting cement material is poured on the base material and the bottom face of the base material is made of an anti-slip material.
Figure 7:
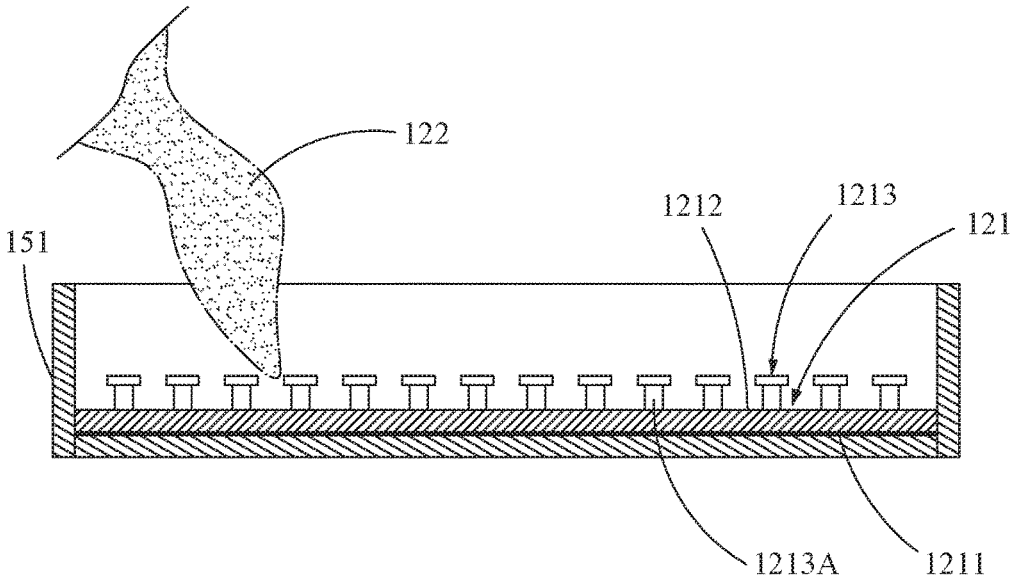
FIG. 7 is a cross-sectional view showing that the bottom face of the base material is made of an adhesive material.
Figure 8:
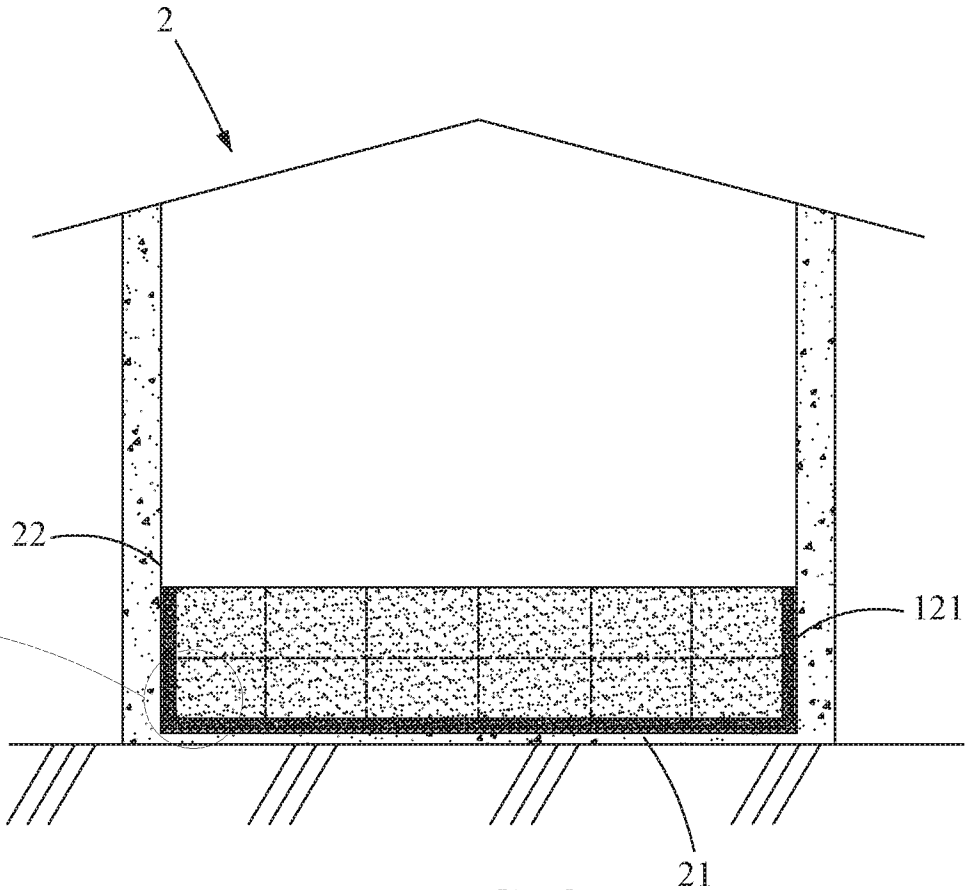
FIG. 8 is a cross-sectional view showing a simulation that the cement plates of the second preferred embodiment of this invention are arranged on the surface of the structure.
Figure 8A:
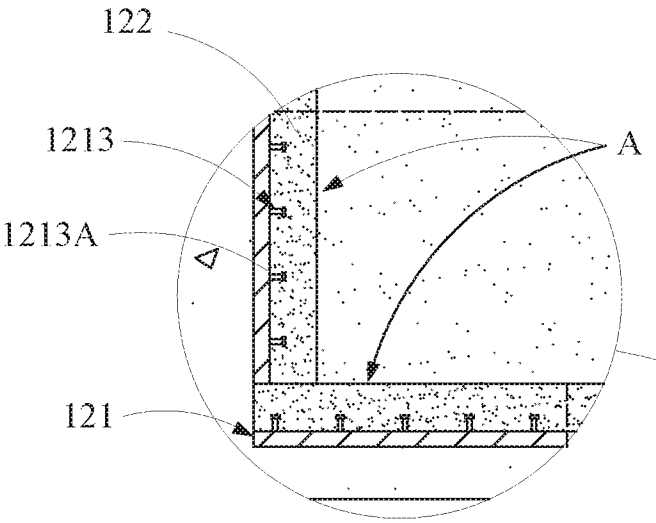
FIG. 8A is an enlarged view showing a partial element of FIG. 8.

Referring to FIGS. 5, 8 and 8A showing a second preferred embodiment of a construction method 1 for protecting a surface of a structure 2 of this invention includes an initial setting step 11, a preparation step 12, a forming step 15, and a covering step 16 in order. Here take that the structure 2 is a building and the surfaces of the structure 2 are the ground 21 and the wall 22 as examples as shown in FIG. 8. The initial setting step 11 is aimed at measuring areas of surfaces of the ground 21 and the wall 22 which is extended from the ground 21 of a construction zone (not shown) of a structure 2. The preparation step 12 is executed by preparing at least one soft base material 121 and a quick setting cement material 122 based on the aforesaid measurement in the initial setting step 11. Referring to FIG. 6, the base material 121 has a bottom face 1211, a top face 1212 opposite to the bottom face 1211, and a plurality of connecting units 1213 formed on the top face 1212. Each connecting unit 1213 further has a first portion 1213A which is connected with the top face 1212 and formed with a reduced size. Meanwhile, the base material 121 is composed of several pieces in this preferred embodiment as shown in FIG. 8. Further, the bottom face 1211 of the base material 121 can be made of an anti-slip material or an adhesive material as shown in FIG. 6 or FIG. 7. Therefore, the bottom face 1211 of the base material 121 can be applied to the ground 21 and the wall 22 that are made of slippery materials without sliding. Hence, the material of the base material 121 can be chosen in accordance with the materials of the ground 21 and the wall 22 to be the anti-slip or the adhesive materials. Meanwhile, an amount of the quick setting cement material 122 is also prepared based on the measurement in the initial setting step 11.

Referring to FIGS. 5 and 6, the forming step 15 is executed by preparing a mold 151 which defines an enclosed space having a depth. The mold 151 allows the base material 121 to locate in the enclosed space of the mold 151. After the base material 121 is placed in the enclosed space of the mold 151, the bottom face 1211 of the base material 121 faces the inside of the mold 151. The top face 1212 and the connecting units 1213 face the outside. Then, the quick setting cement material 122 is poured to be placed on the top face 1212 of the base material 121 until the pouring height of the quick setting cement material 122 meets the requirements. Meanwhile, the quick setting cement material 122 is integrated to become flat and well-mixed. The quick setting cement material 122 further engages with the connecting units 1213 during the solidifying process. Therefore, the quick setting cement material 122 can engage with the base material 121 stably after the quick setting cement material 122 is solidified. A cement plate A is formed after the mold 151 is removed as shown in FIG. 8A. Then is to repeat the forming step 15 to form several cement plates A until an amount of the cement plates A is enough to cover the surfaces of the ground 21 and the wall 22 of the construction zone completely. Referring to FIGS. 8 and 8A, the covering step 16 is executed by situating the cement plates A prepared in the forming step 15 on the ground 21 and the wall 22 until the cement plates A cover the ground 21 and the wall 22 of the surfaces of the construction zone entirely.

Referring to FIGS. 5, 8 and 8A, the construction method 1 starts with measuring the areas of the surfaces of the ground 21 and the wall 22 of the construction zone of the structure 2. In the factory, the decorator prepares the mold 151 with the enclosed space having the depth for locating the base material 121 therein and pouring the quick setting cement material 122 into the mold 151 to form several cement plates A in order that the total area of the cement plates A can fit with the measurement of the surfaces. The cement plates A are then transported to the construction zone and laid on the ground 21 and the wall 22 of the construction zone of the structure 2, thereby providing the protection of the ground 21 and the wall 22. Because the cement plates A are formed in the factory before being carried to the construction zone, the time of waiting the quick setting cement material 122 to be solidified is skipped. Hence, the construction can be executed immediately after the cement plates A are placed on the ground 21 and the wall 22, thereby speeding the construction. The cement plates A can effectively bear the high pressure and improper friction caused during the construction to protect the ground 21 and the wall 22 of the structure 2 from being damaged or even broken into pieces, thereby increasing the construction efficiency. In view of that the base material 121 does not adhere to the surfaces of the ground 21 and the wall 22, the cement plates A can be removed from the inside of the structure 2 to the outside by moving the base material 121 without damaging the ground 21 and the wall 22, thereby decreasing the waste, avoiding the occurrence of the environmental pollution, and reducing the cost of construction.

To sum up, the construction method for protecting a surface of a structure of this invention takes advantages of the soft base material and the quick setting cement material paved on the base material to form the cement plate to protect the interior and exterior surfaces of the structure. The cement plate can bear the improper friction and high pressure to prevent the surfaces of the structure from being damaged or broken during the construction. Whereby the construction can be executed favorably and the construction efficiency is increased effectively. Further, the cement plate can be removed with ease by moving the base material because the base material does not stick to the surfaces of the structure. Besides, the base material can be reused after the quick setting cement material is separated from the base material, thereby preventing the occurrence of the environmental pollution and decreasing the cost of construction.

While the embodiments of this invention are shown and described, it is understood that further variations and modifications may be made without departing from the scope of this invention.

What is claimed is:

1. A construction method for protecting a surface of a structure comprising:

measuring an area of a surface of a construction zone of a structure, preparing at least one soft base material and a quick setting cement material according to said measuring step, said base material including a bottom face, a top face opposite to said bottom face, and a plurality of connecting units formed on said top face, each of said connecting units having a first portion which is in contact with said top face and provided with a reduced size;

laying said base material on said measured surface of said structure and paving said base material with said quick setting cement material; and leveling said quick setting cement material which is paved on said base material to make said quick setting cement material flat and even and then solidifying said quick setting cement material on said base material to form a complete cement plate.

2. The construction method as claimed in claim 1, wherein said bottom face of said base material is made of an anti-slip material capable of providing a non-slip effect.

3. The construction method as claimed in claim 1, wherein said bottom face of said base material is made of an adhesive material capable of providing a bonding effect.

4. A construction method for protecting a surface of a structure comprising:

measuring an area of a surface of a construction zone of a structure, preparing at least one soft base material and a quick setting cement material according to said measuring step, said base material including a bottom face, a top face opposite to said bottom face, and a plurality of connecting units formed on said top face, each of said connecting units having a first portion which is in contact with said top face and provided with a reduced size;

preparing at least one mold which defines an enclosed space having a depth, placing said base material in said enclosed space of said mold, covering said base material with said quick setting cement material to allow said quick setting cement material to become solidified on said base material, and then removing said mold to form a cement plate; and laying said cement plate on said surface of said construction zone of said structure until said surface is completely covered with said cement plate.

5. The construction method as claimed in claim 4, wherein said bottom face of said base material is made of an anti-slip material capable of providing a non-slip effect.

6. The construction method as claimed in claim 4, wherein said bottom face of said base material is made of an adhesive material capable of providing a bonding effect.

* * * * *